US007364052B2

(12) United States Patent
Spatafora

(10) Patent No.: US 7,364,052 B2
(45) Date of Patent: Apr. 29, 2008

(54) UNIT FOR FEEDING CIGARETTES TO A PACKER MACHINE

(75) Inventor: Mario Spatafora, Bologna (IT)

(73) Assignee: G.D S.p.A., Bologna (IT)

( * ) Notice: Subject to any disclaimer, the term of this patent is extended or adjusted under 35 U.S.C. 154(b) by 451 days.

(21) Appl. No.: 10/471,099

(22) PCT Filed: Apr. 15, 2002

(86) PCT No.: PCT/IB02/01235

§ 371 (c)(1),
(2), (4) Date: Sep. 8, 2003

(87) PCT Pub. No.: WO02/083502

PCT Pub. Date: Oct. 24, 2002

(65) Prior Publication Data

US 2004/0104240 A1 Jun. 3, 2004

(30) Foreign Application Priority Data

Apr. 17, 2001 (IT) ..... BO2001A0225

(51) Int. Cl.
*B65G 59/00* (2006.01)
*B65G 47/28* (2006.01)

(52) U.S. Cl. ..... 221/289; 198/459.6; 198/452; 198/453; 131/282; 131/280; 131/283

(58) Field of Classification Search ..... 221/289; 198/459.6, 452, 453; 131/282, 280, 283
See application file for complete search history.

(56) References Cited

U.S. PATENT DOCUMENTS

| | | | | |
|---|---|---|---|---|
| 2,592,642 | A * | 4/1952 | Bardet | 414/792.5 |
| 3,207,308 | A * | 9/1965 | Kemp | 209/535 |
| 3,305,128 | A * | 2/1967 | Dearsley | 221/9 |
| 3,501,052 | A | 3/1970 | Rudszinat | |
| 3,596,797 | A * | 8/1971 | Wallenborn | 221/10 |
| 4,147,247 | A * | 4/1979 | Clarke | 198/572 |
| 4,196,810 | A * | 4/1980 | Gurioli | 209/535 |
| 4,574,958 | A * | 3/1986 | Manservisi | 209/535 |
| 4,691,848 | A * | 9/1987 | Gianese | 222/269 |
| 4,953,711 | A * | 9/1990 | Focke | 209/535 |
| 4,962,629 | A * | 10/1990 | Focke | 53/498 |
| 5,224,811 | A * | 7/1993 | Sigrist et al. | 414/289 |
| 6,065,358 | A * | 5/2000 | Shepherd | 73/865.8 |
| 6,446,632 | B1 * | 9/2002 | Focke | 131/282 |

FOREIGN PATENT DOCUMENTS

| | | |
|---|---|---|
| GB | 485240 | 5/1938 |
| GB | 782792 | 9/1957 |

* cited by examiner

*Primary Examiner*—Patrick Mackey
*Assistant Examiner*—Michael Butler
(74) *Attorney, Agent, or Firm*—Timothy J. Klima

(57) ABSTRACT

A unit for feeding cigarettes to a packer machine is equipped with a hopper containing a mass of cigarettes and a device serving to compensate the depletion of the mass as groups of cigarettes are removed from the hopper and directed into a plurality of boxes carried and transported by a conveyor. The compensating device is located internally of the hopper and comprises an articulated mechanism designed to create a movable wall, also a pair of lateral conveyors converging toward the articulated mechanism, its operation being coordinated with that of a further device by which the groups of cigarettes are removed from the hopper, in such a way as to vary the capacity of the hopper according to the volume of cigarettes removed.

16 Claims, 3 Drawing Sheets

UNIT FOR FEEDING CIGARETTES TO A PACKER MACHINE

This application is the national phase of international application PCT/IB02/01235 filed Apr. 15, 2002 which designated the U.S. and that international application was published under PCT Article 21(2) in English. This application claims priority to Italy Patent application number BO2001A 000225 filed Apr. 17, 2001.

TECHNICAL FIELD

The present invention relates to a unit for feeding cigarettes to a packaging machine, or packer.

In conventional systems for the manufacture and packaging of cigarettes, a cigarette maker is connected by way of a feed channel to the top inlet of a hopper containing a mass of cigarettes. The hopper presents a plurality of outlets from which groups of cigarettes are collected cyclically and fed to the wrapping line of a cigarette packer.

The hopper functions conventionally as a temporary storage unit operating between the feed channel, which supplies a continuous flow of cigarettes, and the aforementioned outlets, from which the groups of cigarettes are collected cyclically.

BACKGROUND ART

In systems of the type mentioned above, which are typified by high operating speeds, a considerable number of cigarettes will be collected cyclically at a relatively high frequency. Consequently, successive collection cycles tend to create somewhat sizeable voids in the mass of cigarettes occupying the hopper, especially in the part of the hopper disposed nearest to the outlets. These voids generate imbalances during a given collection cycle that are unable to self-correct, with the result that the cigarettes are caused to assume an incorrect positional arrangement likely to jeopardize the outcome of the next cycle. In particular, a few cigarettes can become lodged transversely to the remainder and thus occasion a jam internally of the hopper.

The problem in question can be remedied, according to one prior art solution, by using a hopper of which the part directly above the outlets is oversized volumetrically. This ensures that the imbalances mentioned above will have little effect on the mass of cigarettes located above the outlets since the overall volume of the voids created in the mass is negligible in relation to the volume of the mass of cigarettes lying above the outlets.

The solution in question betrays a drawback nonetheless, deriving from the fact that the cigarettes immediately adjacent to the outlets of the hopper are compressed by the considerable mass of cigarettes lying above the outlets. Consequently, the cigarettes risk being crushed and damaged, shedding a part of the tobacco filler from the non-tipped ends or losing their correct cylindrical shape.

The object of the present invention is to provide a unit for feeding cigarettes to a packer machine in which the relative hopper is unaffected by the above noted drawbacks.

DISCLOSURE OF THE INVENTION

The stated object is realized according to the present invention in a unit for feeding cigarettes to a packer machine, comprising a hopper designed to contain a mass of cigarettes, presenting a top feed inlet and a plurality of bottom outlets, ejector means associated with each outlet and capable of movement cyclically in such a way as to remove respective groups of cigarettes from the mass, and container means by which the groups are taken up and transferred to the packer machine, characterized in that it comprises compensating means located internally of the hopper and serving to vary the capacity of the selfsame hopper in response to the change induced in the mass of cigarettes by the removal of the groups.

The invention will now be described in detail, by way of example, with the aid of the accompanying drawings, in which.

Figure 1:
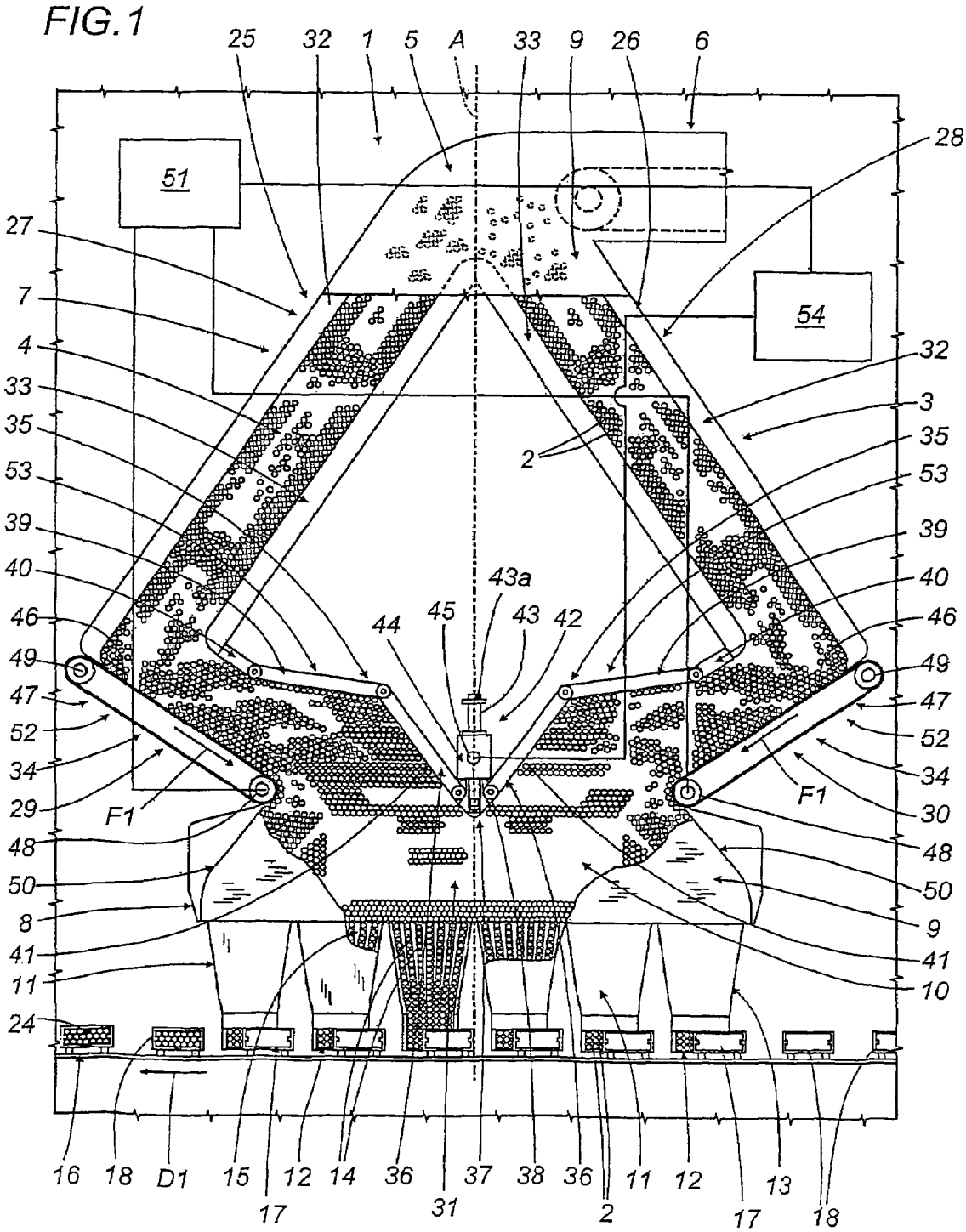
FIGS. 1 and 2 illustrate a portion of a feed unit for cigarettes according to the invention, viewed schematically in a front elevation with certain parts cut away and others omitted for clarity, and shown in two different operating configurations.
Figure 2:
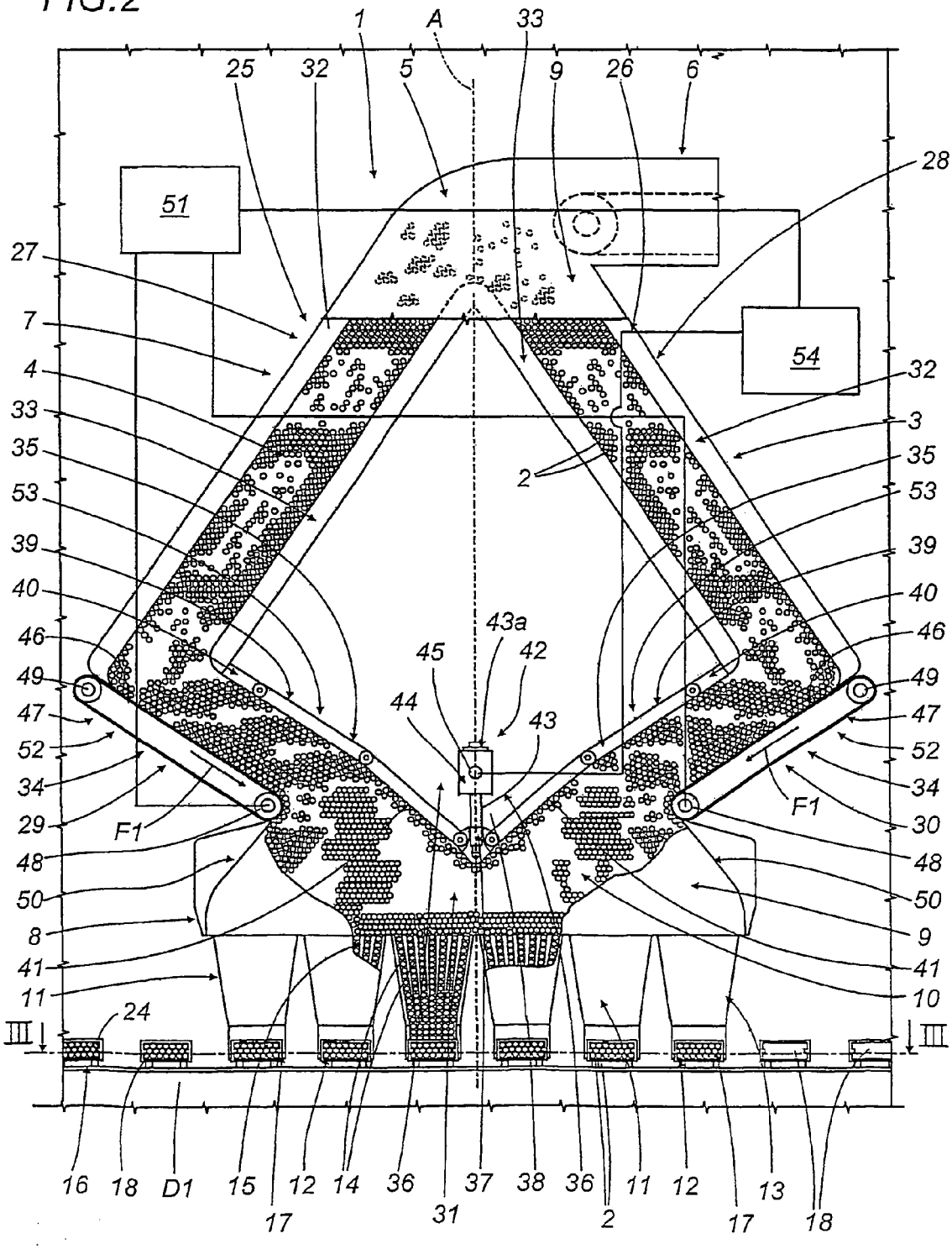

With reference to FIGS. 1 and 2 of the drawings, 1 denotes a unit, in its entirety, for feeding cigarettes 2 to a packer machine (not illustrated).

The unit 1 comprises a hopper 3 containing a mass 4 of cigarettes 2 conveyed to the top inlet 5 of the selfsame hopper 3 by way of a horizontal channel 6 linked to an upstream machine, namely a cigarette maker (not illustrated).

The horizontally disposed cigarettes 2 advance side by side and transversely to their respective axes as they proceed through the hopper 3, which presents a substantially symmetrical structure, relative to a vertical longitudinal axis A, comprising a top part 7 and a bottom part 8 delimited vertically by a front wall 9 and a rear wall 10.

It will be seen in FIGS. 1 and 2 that certain of the cigarettes 2 in the mass 4 occupying the hopper have been omitted purely to simplify the drawing, whereas in effect the mass 4 is substantially compact and uniform, and flows from the top part 7 to the bottom part 8 without voids or gaps attributable to the absence of cigarettes 2.

Figure 4:
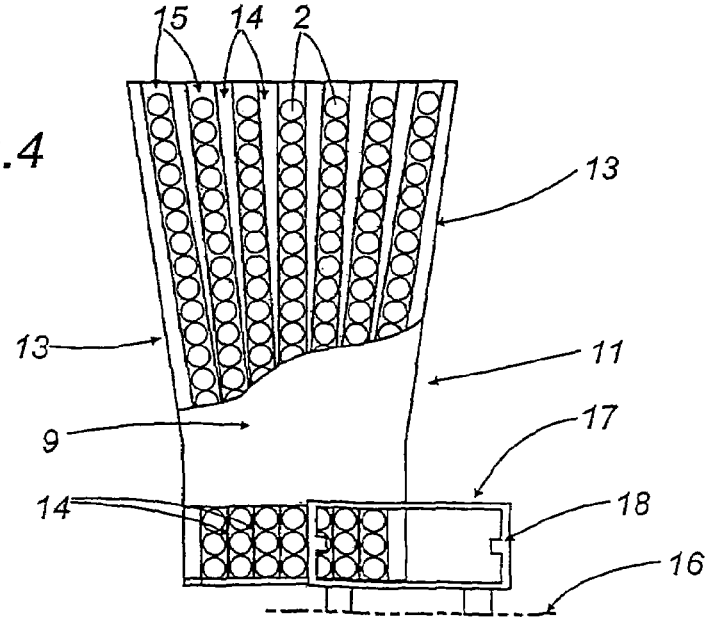
FIG. 4 illustrates an enlarged detail of FIGS. 1 and 2, viewed with certain parts cut away and others omitted.

The bottom part 8 of the hopper affords a plurality of bottom outlets 11 equispaced one from the next and numbering six in the example of FIGS. 1 and 2, of which the details are illustrated in FIG. 4. The outlets 11 are enclosed by relative horizontal base plates 12, delimited by respective side walls 13 and partitioned internally by a plurality of baffles 14 establishing channels 15 internally of which the cigarettes 2 are accommodated in substantially vertical stacks.

Also illustrated in FIGS. 1 and 2 is a horizontal belt conveyor 16 running past the outlets 11 on the side of the front vertical wall 9; the belt is looped around respective pulleys (not illustrated) and carries a plurality of container means 17 consisting in individual boxes 18 with respective longitudinal axes extending parallel to the axes of the single cigarettes 2. The boxes 18 are intended to contain respective groups of cigarettes 2 and caused to advance in a predetermined direction D1 transverse to the axes of the cigarettes 2, in such a manner that with each step indexed by the conveyor 16, an empty box 18 is brought into alignment with a respective outlet 11.

Figure 3:
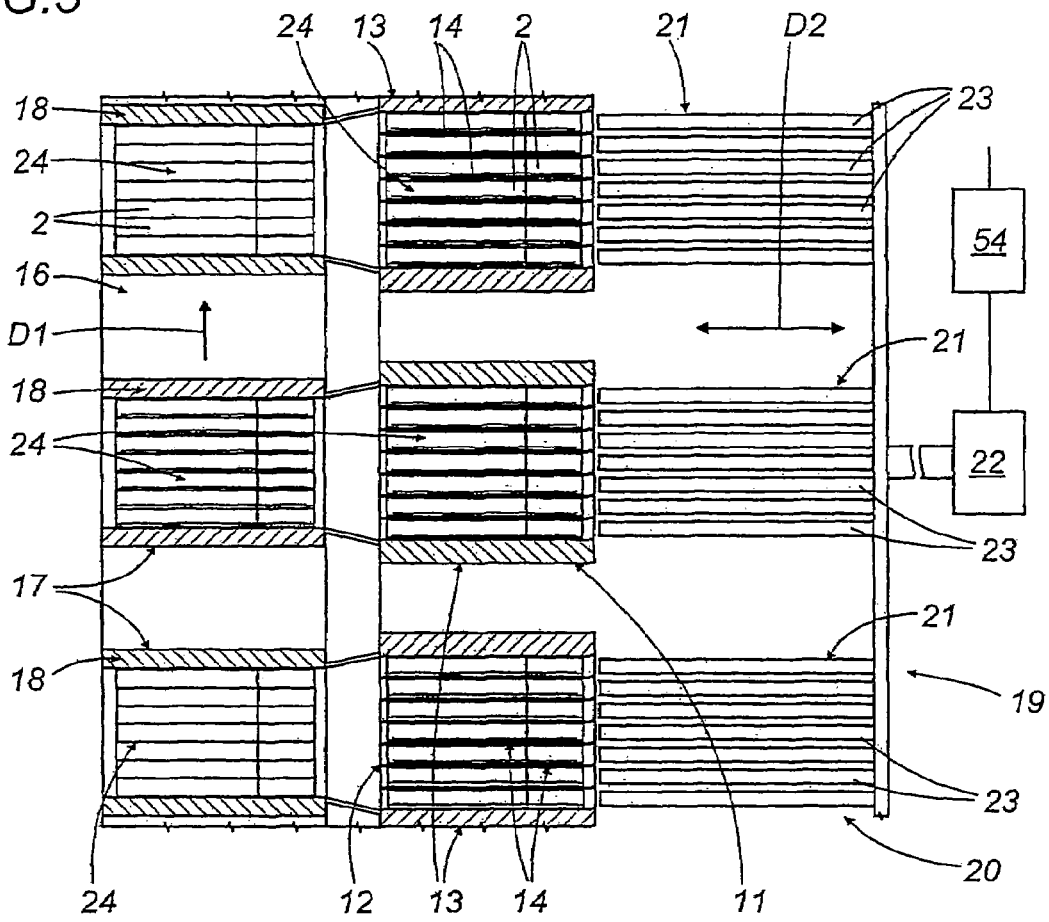
FIG. 3 illustrates a detail of FIG. 2, viewed schematically from above on III-III in FIG. 2, with certain parts omitted and others in section.

Located on the opposite side of the hopper 3 from the conveyor 16, as discernible in FIG. 3 which shows three of the six outlets 11, is a transfer device 19 comprising a plurality of ejector means 20 equal in number to the number of outlets 11, associated each with a relative outlet and embodied, in particular, as respective finger pushers 21. The pushers 21 are capable of reciprocating movement, generated cyclically as a forward stroke and a return stroke, in a predetermined direction D2 transverse to the direction D1 followed by the conveyor 16, through the agency of actuator means indicated schematically as a block denoted 22.

Each of the finger pushers 21 comprises a plurality of prongs 23 equal in number to the number of the aforementioned channels 15 of the outlets 11, which are able thus during the forward stroke to engage a group 24 of cigarettes 2 formed on the base plate 12 of the relative outlet 11 and direct it into a respective box 18 on the conveyor 16, by which the groups 24 are transferred to the packer.

Referring to FIGS. 1 and 2, the top part 7 of the hopper 3 is divided at the inlet 5 so as to create two channels, left and right, denoted 25 and 26 respectively. The two channels 25 and 26 present respective first legs 27 and 28 extending divergently downward and into respective second legs 29 and 30 extending in turn convergently toward a zone 31 of confluence which is filled by the descending mass of cigarettes 2 and coincides with the bottom part 8 of the hopper 3, immediately above the outlets 11.

The first legs 27 and 28 of the channels 25 and 26 are compassed by respective first pairs of fixed outer side walls 32 and fixed inner side walls 33, whilst the second legs 29 and 30 are compassed by second pairs of outer side walls 34 and inner side walls 35.

The top part 7 of the hopper 3 presents a structure of substantially rhomboidal geometry, with the aforementioned vertical axis A constituting an axis of symmetry and coinciding with the greater diagonal of the rhomboidal figure.

As discernible from FIGS. 1 and 2, each second inner side wall 35 comprises a respective first movable plate 36. The first plates 36 are connected pivotably one to another by first ends at a common hinge 37 consisting in a wedge 38, and hinged also by respective second ends to second movable plates 39 also forming part of the second inner side walls 35.

Each second plate 39 is pivotably associated by way of a fixed hinge with the end of a short fixed section 40 presented by the respective inner side wall 35. The fixed sections 40 are rigidly associated with the bottom ends of the inner side walls 33 presented by the respective first legs 27 and 28.

The first plates 36, the wedge 38 and the second plates 39 present a transverse dimension, that is, normal to the viewing plane of FIGS. 1 and 2, is substantially identical to the distance between the vertical walls 9 and 10 of the hopper 3. The two first plates 36 and the two second plates 39 combine also to establish a movable wall 41 which together with the wedge 38 delimits the aforementioned zone 31 of confluence 31 on the side uppermost. The wall 41 forms part of an articulated mechanism 42 in which the wedge 38 coincides with a vertex of the selfsame movable wall 41 directed toward the outlets 11.

The articulated mechanism 42 is symmetrical in relation to the vertical axis A of the hopper 3 and comprises a guide rod 43 of which the axis is disposed vertical and parallel to the hopper axis A. The rod 43 is fixed by a bottom end to the wedge 38 and carried freely in a support and slide element 44 connected to the hopper 3 in a manner not indicated.

The articulated mechanism 42 is capable of movement between a first upper limit position illustrated in FIG. 1 and corresponding to the maximum capacity of the hopper 3, and a second lower limit position illustrated in FIG. 2 and corresponding to the minimum capacity of the hopper 3.

In moving toward the first upper limit position aforementioned, the two pairs of first and second plates 36 and 39 pivot one toward the other, rotating about the common hinge, and the wedge 38 assumes a raised position of maximum distance from the hopper outlets 11.

In moving toward the second lower limit position aforementioned, the two pairs of first and second plates 36 and 39 pivot away from one another, rotating about the common hinge to assume a position substantially of mutual alignment, and the wedge 38 assumes a lowered position of minimum distance from the hopper outlets 11.

The movement of the articulated mechanism toward the second lower limit position occurs by gravity.

With the movement of the articulated mechanism 42, the rod 43 likewise is caused to assume two limit positions, one raised and one lowered, the latter determined by an annular stop 43*a*.

A sensor 45 mounted to the rod 43 serves to identify the position assumed by the selfsame rod 43 relative to the support and slide element 44.

Still in FIGS. 1 and 2, the outer side walls 34 of the second convergent legs 29 and 30 are provided by the rectilinear top branches 46 of respective belt conveyors 41 each looped around respective pulleys 48 and 49.

The two pulleys denoted 48 are positioned lower than the remaining two pulleys 49 and serve each to establish a surface interconnecting the respective second leg 29 and 30 and a side wall 50 of the bottom part 8 of the hopper 3.

The pulleys 49 uppermost connect with the bottom ends of the outer side walls 32 presented by the two divergent legs 27 and 28 of the hopper 3.

One of the two pulleys 48 and 49 of each belt conveyor 47, for example the pulley denoted 48 as shown in FIGS. 1 and 2, is connected to a motor indicated schematically by a block denoted 51. The conveyors 47 are driven by the motor 51 in such a way that the respective top branches 46 move toward the axis A of symmetry, in the direction of the arrows denoted F1. Accordingly, the two conveyors 47 constitute means 52 by which to advance the mass 4 of cigarettes 2 toward the zone 31 of confluence.

The articulated mechanism 42 and the guide rod 43 combine with the belt conveyors 47 to establish compensating means 53 by which the capacity of the hopper 3 can be varied so as to accommodate the change induced in the mass 4 of cigarettes 2 as a result of the removal of groups 24 by the transfer device 19.

In operation, the mass 4 of cigarettes 2 advancing along the feed channel 6 enters the hopper 3 through the inlet 5. Let it be supposed, at first, that the hopper 3 is filled completely and to its maximum capacity as illustrated in FIG. 1, the transfer device 19 is in the retracted position of FIG. 3, and the conveyor 16 has brought six empty boxes 18 into alignment with the outlets 11 and the finger pushers 21.

The actuator 22 of the transfer device 19 makes its forward stroke, with the result that six groups 24 of cigarettes 2 are ejected from the outlets 11 and directed into the corresponding boxes 18; as the transfer device 19 returns to its initial position with the prongs 23 retracted from the channels 15 of the outlets 11, the absence of the cigarettes 2 just removed will occasion a reduction in the part of the mass 4 of cigarettes 2 occupying the bottom part 8 of the hopper 3. This reduced mass is nonetheless compensated instantly by the articulated mechanism 42 which, moving under the force of gravity, assumes the position of FIG. 2 corresponding to the minimum capacity of the hopper 3; the rod 43 likewise assumes the lowered position, descending to a lower level detected by the sensor 45, which relays a signal to a controller denoted 54. The controller 54, which is connected to the motor 51, responds by causing the top branches 46 of the conveyors 47 to accelerate in the feed direction F1.

As a result, the mass 4 of cigarettes 2 occupying the second legs 29 and 30 of the hopper will be made to advance more quickly along these same legs, through the agency of the conveyors 47. The mass 4 of cigarettes 2 thus generates a transverse thrust on the movable wall 41, so that the pairs of first and second plates 36 and 39 will gradually regain the position occupied initially, with the rod 43 in the raised position; the hopper 3 resumes the configuration of maximum capacity, having compensated the void created following the ejection of a part of the mass 4 of cigarettes 2 by the transfer device 19 and obviated the possibility that any imbalances caused by the transfer in the bottom part 8 of the hopper 3 will affect the top part 7 of the hopper 3 and the infeed channel 6.

It will be seen from the foregoing description that the conveyors 47 are driven continuously and their speed is variable according to the change induced in the mass 4 as a result of cigarettes 2 being removed by the transfer device 19.

In particular, as discernible from FIG. 3, the actuator 22 of the transfer device 19 is also interlocked to the controller 54 in such a way that the operation of the transfer device 19 and the compensating means 53 can be suitably coordinated.

The invention claimed is:

1. A unit for feeding cigarettes to a packer machine, comprising a hopper for containing a mass of cigarettes, including a top feed inlet and a plurality of bottom outlets, ejector means including a plurality of finger pushers, each associated with respective outlet and capable of movement cyclically in such a way as to remove respective groups of cigarettes from the mass, wherein the hopper is divided into at least two channels departing from the feed inlet and meeting at a zone of confluence lying above the outlets, and container means including a plurality of individual boxes, each of them to contain and transfer a group of cigarettes to the packer machine, wherein it comprises compensating means located internally of each channel of the hopper and serving to vary the capacity of the selfsame hopper in response to the change induced in the mass of cigarettes by the removal of the groups.

2. A unit as in claim 1, wherein the compensating means comprise at least one movable wall capable of movement between at least two limit positions corresponding respectively to a maximum capacity and a minimum capacity of the hopper, of which the timing is coordinated selectively with the cyclical movement of the ejector means.

3. A unit as in claim 2, wherein the compensating means comprise at least one articulated mechanism incorporating the movable wall, the movable wall in turn delimiting the zone of confluence at least in part.

4. A unit as in claim 3, wherein the two channels comprise respective first divergent legs compassed between respective first pairs of fixed inner side walls and fixed outer side walls, also second legs converging on the zone of confluence and delimited by respective second pairs of inner side walls and outer side walls.

5. A unit as in claim 4, wherein the movable wall created by the articulated mechanism comprises at least respective terminal parts of the second inner side walls, comprising at least in respective first plates connected pivotably by one end to a common hinge in such a way as to form a vertex of the movable wall directed toward the bottom outlets.

6. A unit as in claim 5, wherein the movable wall comprises second plates each pivotably associated by way of a first end with a free end of a corresponding first plate and by way of a second end with a respective fixed hinge.

7. A unit as in claim 5, wherein the articulated mechanism is disposed symmetrically relative to a longitudinal axis of the hopper and comprises a guide rod, of which the axis is disposed parallel to the longitudinal axis of the hopper and of which one end is fixed to the common hinge, also means for supporting and slidably accommodating the rod in such a manner that the rod is capable of movement along its own axis between a raised position corresponding to the maximum capacity of the hopper and a lowered position corresponding to the minimum capacity of the hopper.

8. A unit as in claim 7, comprising sensor means associated with the means for supporting and slidably accommodating the rod and serving to detect the position of the rod.

9. A unit as in claim 8, wherein the compensating means comprise means by which to advance the mass of cigarettes lying adjacent to the outer side wails delimiting the second legs of the channels of the hopper.

10. A unit as in claim 9, wherein the means of advancing the mass of cigarettes operate in conjunction with the articulated mechanism and are interlocked to the sensor means.

11. A unit as in claim 10, wherein means of advancing the mass of cigarettes comprise looped belt conveyors of which the relative top branches coincide with the outer side walls delimiting the second legs of the channels of the hopper.

12. A unit as in claim 11, wherein the looped belt conveyors are set in motion by drive means interlocked to the sensor means.

13. A unit as in claim 12, wherein the looped belt conveyors are driven continuously at a speed that is variable in response to changes in a volume of the mass of cigarettes occupying the hopper.

14. A unit as in claim 6, wherein the articulated mechanism is disposed symmetrically relative to a longitudinal axis of the hopper and comprises a guide rod, of which the axis is disposed parallel to the longitudinal axis of the hopper and of which one end is fixed to the common hinge, also means of supporting and slidably accommodating the rod in such a manner that the rod can move along its own axis between a raised position corresponding to the maximum capacity of the hopper and a lowered position corresponding to the minimum capacity of the hopper.

15. A unit as in claim 1, wherein the compensating means are positioned near to and immediately above the outlets.

16. A unit as in claim 2, wherein the compensating means are positioned near to and immediately above the outlets.

* * * * *